US006476176B1

(12) United States Patent
Wu

(10) Patent No.: US 6,476,176 B1
(45) Date of Patent: Nov. 5, 2002

(54) GOLF BALL COMPRISING SATURATED POLYURETHANES AND METHODS OF MAKING THE SAME

(75) Inventor: Shenshen Wu, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/466,434

(22) Filed: Dec. 17, 1999

(51) Int. Cl.[7] ..... A63B 37/12

(52) U.S. Cl. ..... 528/76; 528/61; 528/65; 473/354; 473/365; 473/374; 473/376; 473/378

(58) Field of Search ..... 528/76, 61, 65; 473/378, 354, 365, 374, 376

(56) References Cited

U.S. PATENT DOCUMENTS

| | | | | | |
|---|---|---|---|---|---|
| 3,147,324 | A | | 9/1964 | Ward | 264/254 |
| 3,264,272 | A | | 8/1966 | Rees | 260/78.5 |
| 3,454,280 | A | | 7/1969 | Harrison et al. | 273/235 |
| 3,819,768 | A | | 6/1974 | Molitor | 260/897 B |
| 4,123,061 | A | | 10/1978 | Dusbiber | 273/220 |
| 4,323,247 | A | | 4/1982 | Keches et al. | 273/235 R |
| 4,431,193 | A | | 2/1984 | Nesbitt | 273/235 R |
| 4,526,375 | A | | 7/1985 | Nakade | 273/235 R |
| 4,884,814 | A | | 12/1989 | Sullivan | 273/235 R |
| 4,911,451 | A | | 3/1990 | Sullivan et al. | 273/235 R |
| 5,334,673 | A | | 8/1994 | Wu | 273/235 R |
| 5,484,870 | A | | 1/1996 | Wu | 528/28 |
| 5,692,974 | A | | 12/1997 | Wu et al. | 473/377 |
| 5,733,428 | A | | 3/1998 | Calabria et al. | 264/134 |
| 5,779,561 | A | * | 7/1998 | Sullivan | |
| 5,792,008 | A | * | 8/1998 | Kakiuchi | |
| 5,908,699 | A | | 6/1999 | Kim | 428/408 |
| 5,929,189 | A | * | 7/1999 | Ichikawa | |
| 5,977,264 | A | * | 11/1999 | Ichikawa | |
| 5,993,968 | A | * | 11/1999 | Umezawa | |
| 6,231,460 | B1 | * | 5/2001 | Higuchi | |
| 6,267,692 | B1 | * | 7/2001 | Higuchi | |

OTHER PUBLICATIONS

Grant & Hackh's Chemical Dictionary 5th Edition p. 118, Feb. 1990.*

John A. Schey, Introduction to Manufacturing Processes 410 (Anne Duffy, ed., McGraw–Hill 2d ed. 1987) (1977).

* cited by examiner

*Primary Examiner*—David J. Buttner
(74) *Attorney, Agent, or Firm*—Swidler Berlin Shereff Friedman, LLP

(57) ABSTRACT

The invention provides a golf ball having a cover and intermediate layers comprising in whole or in part of a saturated polyurethane. The saturated polyurethane may be blended with conventional materials employed to form golf balls, cores and intermediate layers.

25 Claims, 4 Drawing Sheets

GOLF BALL COMPRISING SATURATED POLYURETHANES AND METHODS OF MAKING THE SAME

FIELD OF THE INVENTION

The invention relates to golf balls and, more particularly, to golf balls having covers and intermediate layers which comprise a saturated polyurethane, and methods for making the same. Preferably, the cover of the golf ball is formed from a saturated polyurethane to produce a UV stable cover.

BACKGROUND OF THE INVENTION

Golf ball covers are formed from a variety of materials, including balata and ionomer resins. Balata is a natural or synthetic trans-polyisoprene rubber. Balata covered balls are favored by the more highly skilled golfers because the softness of the cover allows the player to achieve spin rates sufficient to more precisely control ball direction and distance, particularly on shorter shots.

However, balata covered balls are easily damaged, and thus lack the durability required by the average golfer. Accordingly, alternative cover compositions have been developed in an attempt to provide balls with spin rates and a feel approaching those of balata covered balls, while also providing a golf ball with a higher durability and overall distance.

Ionomer resins have, to a large extent, replaced balata as a cover stock material. Chemically, ionomer resins are a copolymer of an olefin and an alpha, beta ethylenically-unsaturated carboxylic acid having 10–90% of the carboxylic acid groups neutralized by a metal ion. See U.S. Pat. No. 3,264,272. Commercially available ionomer resins include, for example, copolymers of ethylene and methacrylic or acrylic acid neutralized with metal salts. These are sold by E.I. DuPont de Nemours and Co. under the trademark "SURLYN®" and by the Exxon Corporation under the trademark "ESCOR®" and the trademark "IOTEK®". These ionomer resins are distinguished by the type of metal ion, the amount of acid, and the degree of neutralization.

U.S. Pat. Nos. 3,454,280, 3,819,768, 4,323,247, 4,526,375, 4,884,814, and 4,911,451 all relate to the use of SURLYN®-type compositions in golf ball covers. However, while SURLYN® covered golf balls as described in the preceding patents possess virtually cutproof covers, they have inferior spin and feel properties as compared to balata covered balls.

Polyurethanes have also been recognized as useful materials for golf ball covers since as early as about 1960. U.S. Pat. No. 3,147,324, filed Oct. 20, 1960, is directed to a method of making a golf ball having a polyurethane cover. The curing agents disclosed are diamines, polyols or air moisture. The disclosed polyurethane covered golf balls are durable, while at the same time maintaining the "feel" of a balata ball.

Since 1960, various companies have investigated the usefulness of polyurethane as a golf ball cover material. U.S. Pat. No. 4,123,061 issued Oct. 31, 1978 teaches that a golf ball can be made from a polyurethane prepolymer of polyether and a curing agent, such as a trifunctional polyol, a tetrafunctional polyol or a diamine. U.S. Pat. No. 5,334,673 issued Aug. 2, 1994 discloses the use of two categories of polyurethane available on the market, i.e., thermoset and thermoplastic polyurethanes for forming golf ball covers, and in particular, thermoset polyurethane covered golf balls made from a composition of polyurethane prepolymer and a slow-reacting amine curing agent and/or a difunctional glycol.

The first commercially successful polyurethane covered golf ball was Titleist's PROFESSIONAL golf ball in 1993. The principal reason for the delay in bringing polyurethane composition golf ball covers on the market was that it was a daunting engineering task to apply a covering of polyurethane composition to a golf ball core to form a golf ball cover having a uniform thickness.

In particular, the difficulty resided in centering a golf ball core in an amount of polyurethane that was sufficiently cured to keep the core centered while at the same time being insufficiently cured so that the cover material could be molded around the core. Resolution of this problem thus enabled production of the aforesaid PROFESSIONAL polyurethane covered golf ball to commence in 1993.

Unlike SURLYN® covered golf balls, polyurethane golf ball covers can be formulated to possess the soft "feel" of balata covered golf balls. However, golf ball covers made from polyurethane have not, to date, fully matched SURLYN® golf balls with respect to resilience or the rebound of the golf ball cover, which is a function of the initial velocity of a golf ball after impact with a golf club.

Furthermore, because the polyurethanes used to make the covers of such golf balls contain an aromatic component, e.g., an aromatic diisocyanate, polyol or polyamine, they are susceptible to discoloration upon exposure to light, particularly UV light. To slow down the discoloration, light and UV stabilizers, e.g., Tinuvin 770, 765 and 328, are added to these aromatic polymeric materials. However, to further ensure that the covers formed from aromatic polyurethanes do not appear discolored, the covers are painted with white paint and then with a clear coat to maintain the white color of the golf ball. The application of a uniform white pigmented coat to the dimpled surface of the golf ball is a difficult process which adds time and costs to the manufacture of the golf ball. Thus, there remains a need for polyurethane materials which do not discolor and which are suitable for forming a golf ball.

SUMMARY OF THE INVENTION

The invention is directed to a golf ball having at least one layer, formed of a saturated polyurethane. The term "saturated" as used herein refers to polyurethanes having saturated aliphatic and alicyclic polymer backbones, i.e., with no double bonds. In particular, the invention relates to a golf ball having at least one layer, such layer being formed of a saturated polyurethane, which is substantially free of unsaturated carbon-carbon bonds or aromatic groups. In this regard the components used in forming the saturated polyurethanes as used in the invention should be substantially free of unsaturated carbon-carbon bonds or aromatic groups. Thus, the saturated polyurethane should be formed of saturated polyols, saturated diisocyanates and saturated curing agents.

The use of such polyurethanes in the golf ball cover obviates the need to paint the golf ball with white paint prior to applying a clear topcoat to the ball. Unlike polyurethanes which contain aromatic groups or moieties, the saturated polyurethanes used in forming the golf balls of the present invention do not discolor upon exposure, especially repeated or extended exposure, to light. Also, by eliminating at least one coating step, the manufacturer realizes economic benefits in terms of reduced process times and consequent improved labor efficiency. Further, significant reduction in volatile organic compound ("VOC") levels may be realized, as such VOC's are a typical constituent of the paint used on golf balls. Therefore, the use of saturated polyurethanes to form white covered golf balls offers significant environmental, as well as cost, benefits.

If desired, although, as noted above, it is not necessary to paint the golf balls of the invention, the saturated polyurethanes used in forming the golf balls of the invention may be used in golf balls which are painted white. The value of such balls may be enhanced due to the enhanced color stability provided by the saturated polyurethanes as the surface paint is removed from the ball during the course of play. Such golf balls will not demonstrate the discoloration often observed in golf ball covers constructed of aromatic polyurethanes.

While saturated polyurethanes will generally be used in forming some or all of the cover of the golf ball of the invention, they may also or alternatively comprise one or more intermediate layer(s) located between the cover and the core. The saturated polyurethane may comprise anywhere from 1 to 100% by weight of the intermediate layer(s) and/or the cover of the golf ball.

A "cover" or a "core" as these terms are used herein includes a structure comprising either a single layer or one with two or more layers. As used herein, a core described as comprising a single layer means a unitary or "one-piece" core. The "layer" thus includes the entire core from the center of the core to its outer periphery. A core, whether formed from a single layer or from two or more layers may serve as a center for a wound ball. An intermediate layer may be incorporated, for example, with a single layer or multilayer cover, with a single layer or multilayer core, with both a single layer cover and core, or with both a multilayer cover and a multilayer core. A layer may additionally be composed of a tensioned elastomeric material, i.e., known as a wound layer. Intermediate layers of the type described above are sometimes referred to in the art, and, thus, herein as well, as an inner cover layer, as an outer core layer, or as a mantle layer.

The invention is directed in a first embodiment to one-piece golf balls comprised of a saturated polyurethane, as well as to other embodiments involving two-piece and multi-component, e.g., three-piece, golf balls comprising at least one cover layer and a core, wherein at least one cover layer comprises at least one saturated polyurethane, as well as multi-component golf balls comprising cores or covers having two or more layers, wherein at least one such layer(s) is formed of at least one saturated polyurethane.

More particularly, the present invention is directed, in a first embodiment, towards a golf ball comprising at least a cover and at least one core layer wherein the cover is formed from a composition comprising at least one saturated polyurethane.

The present invention is further directed in a second embodiment towards a golf ball comprising a cover, a core and at least one intermediate layer interposed between the cover and an outermost core layer, wherein the intermediate layer is formed from a composition comprising at least one saturated polyurethane.

The present invention is yet further directed in a third embodiment towards a golf ball comprising a cover, a core and at least one intermediate layer interposed between the cover and the core, wherein the outermost cover layer and at least one intermediate layer are both formed from a composition comprising at least one saturated polyurethane.

In the golf ball cover embodiment of the present invention, the saturated polyurethane preferably comprises from 1 to 100% by weight of the cover, with the remainder of the cover, if any, being comprised of one or more compatible, resilient polymers such as would be known to one of ordinary skill in the art.

Preferably, the saturated polyurethanes used in forming the golf balls of the present invention can be formed in accordance with the teachings described in U.S. Pat. No. 5,334,673, described above, and 5,484,870. U.S. Pat. No. 5,484,870 describes polyurea compositions, including golf balls employing covers formed of such polyurea compositions, comprising the reaction product of an organic isocyanate and an organic amine, each having at least two functional groups.

DESCRIPTION OF THE PREFERRED EMBODIMENTS

Figure 1:
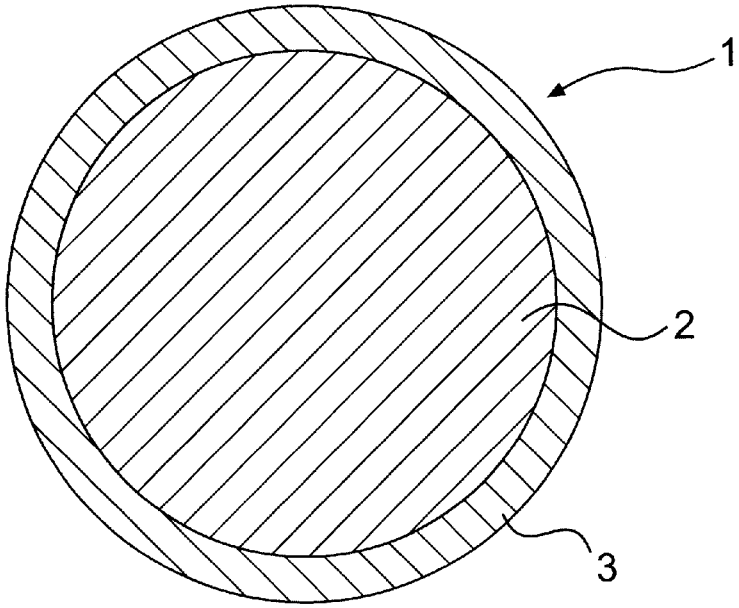
FIG. 1 is a cross-sectional view of a two-piece golf ball wherein the cover is formed from a composition comprising at least one saturated polyurethane.

Broadly, the present invention contemplates a golf ball comprising a saturated polyurethane. The ball may be a one-piece ball formed from a homogeneous mass consisting entirely of such materials, or including blends of conventional golf ball cover materials, such as those discussed hereinbelow, with a saturated polyurethane.

One-piece balls in accordance with the present invention are quite durable, but do not provide great distance because of relatively high spin and low velocity.

A more preferred aspect of the present invention comprises two-piece, multi-component and/or wound balls having cores, intermediate layers and/or covers comprising a saturated polyurethane of the type disclosed herein.

Saturated Polyurethanes

There are two main categories of castable polyurethane available on the market, i.e., thermoset and thermoplastic polyurethanes. Thermoplastic polyurethanes are linear polymers and are typically formed from the reaction of a diisocyanate and a polyol cured with a diol or a secondary diamine. Thermoset polyurethanes, on the other hand, are cross-linked polymers and are typically produced from the reaction of a diisocyanate and a polyol cured with a polyamine or polyfunctional glycol. The saturated polyurethanes used to form the golf balls of the present invention may be selected from among both castable thermoset and thermoplastic polyurethanes.

The saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, a catalyst may be employed to promote the reaction between the curing agent and the isocyanate and polyol.

Saturated diisocyanates which can be used include, without limitation, ethylene diisocyanate; propylene-1,2-diisocyanate; tetramethylene-1,4-diisocyanate; 1,6-hexamethylene-diisocyanate (HDI); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate (IPDI); methyl cyclohexylene diisocyanate ; triisocyanate of HDI; triisocyanate of 2,2,4-trimethyl-1,6-hexane diisocyanate (TMDI). The most preferred saturated diisocyanates are 4, 4'-dicyclohexylmethane diisocyanate (HMDI) and isophorone diisocyanate (IPDI).

Saturated polyols which are appropriate for use in this invention include without limitation polyether polyols such as polytetramethylene ether glycol and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol initiated polycaprolactone, 1,4-butanediol initiated polycaprolactone, 1,6-hexanediol initiated polycaprolactone; trimethylol propane initiated polycaprolactone, neopentyl glycol initiated polycaprolactone, and polytetramethylene ether glycol (PTMEG) initiated polycaprolactone. The most preferred saturated polyols are polytetramethylene ether glycol (PTMEG) and PTMEG initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexanebis(methylamine); triisopropanolamine, ethylene diamine, diethylene triamine, triethylene tetramine, tetraethylene pentamine, 4,4'-dicyclohexylmethane diamine, 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine, hexamethylene diamine, propylene diamine, 1-methyl-2,4-cyclohexyl diamine, 1-methyl-2,6-cyclohexyl diamine, 1,3-diaminopropane, dimethylamino propylamine, diethylamino propylamine, imido-bis-propylamine, isomers and mixtures of isomers of diaminocyclohexane, monoethanolamine, diethanolamine, triethanolamine, monoisopropanolamine, and diisopropanolamine. The most preferred saturated curatives are 1,4-butanediol, 1,4-cyclohexyldimethylol and 4,4'-bis-(sec-butylamino)-dicyclohexylmethane.

Suitable catalysts include, but are not limited to bismuth catalyst, oleic acid, triethylenediamine (DABCO®-33LV), di-butyltin dilaurate (DABCO®-T12) and acetic acid. The most preferred catalyst is di-butyltin dilaurate (DABCO®-T12). DABCO® materials are manufactured by Air Products and Chemicals, Inc.

Cover and Intermediate Layer Compositions

It is well known in the art that if the saturated polyurethane materials are to be blended with other thermoplastics, care must be taken in the formulation process so as to produce an end product which is thermoplastic in nature. Thermoplastic materials may be blended with other thermoplastic materials, but thermosetting materials are difficult if not impossible to blend homogeneously after the thermosetting materials are formed. Preferably, the saturated polyurethane comprises from about 1 to about 100%, more preferably from about 10 to about 75% of the cover composition and/or the intermediate layer composition. About 90 to about 10%, more preferably from about 90 to about 25% of the cover and/or the intermediate layer composition is comprised of one or more other polymers and/or other materials as described below. Such polymers include, but are not limited to polyurethane/polyurea ionomers, polyurethanes or polyureas, epoxy resins, polyethylenes, polyamides and polyesters, polycarbonates and polyacrylin. Unless otherwise stated herein, all percentages are given in percent by weight of the total composition of the golf ball layer in question.

Polyurethane prepolymers are produced by combining at least one polyol, such as a polyether, polycaprolactone, polycarbonate or a polyester, and at least one isocyanate. Thermosetting polyurethanes are obtained by curing at least one polyurethane prepolymer with a curing agent selected from a polyamine, triol or tetraol. Thermoplastic polyurethanes are obtained by curing at least one polyurethane prepolymer with a diol curing agent. The choice of the curatives is critical because some urethane elastomers that are cured with a diol and/or blends of diols do not produce urethane elastomers with the impact resistance required in a golf ball cover. Blending the polyamine curatives with diol cured urethane elastomeric formulations leads to the production of thermoset urethanes with improved impact and cut resistance.

Thermoplastic polyurethanes may be blended with suitable materials to produce a thermoplastic end product. Examples of such additional materials may include ionomers such as the SURLYN®, ESCOR® and IOTEK® copolymers described above.

Other suitable materials which may be combined with the saturated polyurethanes in forming the cover and/or intermediate layer(s)of the golf balls of the invention include ionic or non-ionic polyurethanes and polyureas, epoxy resins, polyethylenes, polyamides and polyesters. For example, the cover and/or intermediate layer may be formed from a blend of at least one saturated polyurethane and thermoplastic or thermoset ionic and non-ionic urethanes/polyurethanes, cationic urethane ionomers and urethane epoxies, ionic and non-ionic polyureas and blends thereof. Examples of suitable urethane ionomers are disclosed in U.S. Pat. No. 5,692,974 entitled "Golf Ball Covers", the disclosure of which is hereby incorporated by reference in its entirety. Other examples of suitable polyurethanes are described in U.S. Pat. No. 5,334,673. Examples of appropriate polyureas are discussed in U.S. Pat. No. 5,484,870 and examples of suitable polyurethanes cured with epoxy group containing curing agents are disclosed in U.S. Pat. No. 5,908,358, the disclosures of which are hereby incorporated herein by reference in their entirety.

A variety of conventional components can be added to the cover compositions of the present invention. These include, but are not limited to, white pigment such as $TiO_2$, ZnO, optical brighteners, surfactants, processing aids, foaming agents, density-controlling fillers, UV stabilizers and light stabilizers. Saturated polyurethanes are resistant to discoloration. However, they are not immune to deterioration in their mechanical properties upon weathering. Addition of UV absorbers and light stabilizers therefore helps to maintain the tensile strength and elongation of the saturated polyurethane elastomers. Suitable UV absorbers and light stabilizers include TINUVIN™ 328, TINUVIN™ 213, TINUVIN™ 765, TINUVIN™ 770 and TINUVIN™ 622. The preferred UV absorber is TINUVIN™ 328, and the preferred light stabilizer is TINUVIN™ 765. TINUVIN™ products are available from Ciba-Geigy. Dyes, as well as optical brighteners and fluorescent pigments may also be included in the golf ball covers produced with polymers formed according to the present invention. Such additional ingredients may be added in any amounts that will achieve their desired purpose. Other conventional ingredients, e.g., density-controlling fillers, ceramics and glass spheres are well known to the person of ordinary skill in the art and may be included in cover and intermediate layer blends of the present invention in amounts effective to achieve their known purpose.

An optional filler component may be chosen to impart additional density to blends of the previously described components. The selection of such filler(s) is dependent upon the type of golf ball desired (i.e., one-piece, two-piece multi-component or wound), as will be more fully detailed below. Generally, the filler will be inorganic, having a density greater than about 2 g/cc, preferably greater than 4 g/cc, and will be present in amounts between 5 and 65 weight percent based on the total weight of the polymer components comprising the layer(s) in question. Examples of useful fillers include zinc oxide, barium sulfate, calcium oxide, calcium carbonate and silica, as well as the other well known corresponding salts and oxides thereof.

Golf Ball Cores

A representative elastomer base composition for forming a golf ball core prepared in accordance with the present invention comprises a base rubber, a crosslinking agent and a filler. The base rubber typically includes natural or synthetic rubbers. A preferred base rubber is 1,4-polybutadiene having a cis-structure of at least 40%. Natural rubber, polyisoprene rubber and/or styrene-butadiene rubber may be optionally added to the 1,4-polybutadiene. Crosslinking agents include metal salts of unsaturated fatty acids, such as zinc or magnesium salts of acrylic or methacrylic acid. The filler typically includes materials such as zinc oxide, barium sulfate, silica, calcium carbonate, metal, glass spheres and the like. The cores of golf balls formed according to the invention may be solid or hollow, fluid-filled or semi-solid filled, one-piece or multi-component cores, or they may, if desired, be wound.

Golf Ball Manufacture

The saturated polyurethanes of the invention can be used to form any type of golf ball, i.e., one-piece, two-piece, wound or multi-component. In particular, two-piece golf balls comprising a cover surrounding a core are within the scope of the present invention, as are wound golf balls, in which a fluid, semi-solid, or solid core is surrounded by a tensioned elastomeric material. The term "fluid" as used herein refers to a liquid or a gas. The term "semi-solid" as used herein refers to a paste, a gel or the like. The term "solid cores" as used herein refers not only to one piece cores but also to those cores having a separate solid layer beneath the cover and above the core as disclosed in U.S. Pat. No. 4,431,193 (the disclosure of which is incorporated herein), and other multilayer and/or non-wound cores. Any type of golf ball core can be used in the golf balls of the present invention. Preferred cores, however, include some amount of cis-polybutadiene. The subject polymers may also be used in golf balls having multiple covers and/or multiple cores.

The core compositions of the invention may be produced by blending a mixture comprising polybutadiene, zinc diacrylate, and at least one saturated polyurethane. In preparing the core blends, when a set of predetermined conditions is met, i.e., time and temperature of mixing, the free radical initiator is added in an amount dependent upon the amounts and relative ratios of the starting components, all of which would be well understood by one of ordinary skill in the art. In particular, as the components are mixed, the resultant shear causes the temperature of the mixture to rise. Peroxide(s) free radical initiator(s) are blended into the mixture for crosslinking purposes in the molding process.

After completion of the mixing, the golf ball core composition is milled and hand prepped or extruded into pieces ("preps") suitable for molding. The milled preps are then compression molded into cores at an elevated temperature. Typically, 160° C. (320° F.) for 15 minutes is suitable for this purpose. These cores can then be used to make finished golf balls by surrounding the cores with intermediate layer and/or cover materials.

One method for forming a polyurethane cover on a golf ball core is disclosed in U.S. Pat. No. 5,733,428, which method is incorporated by reference herein. This method relates to the use of thermosetting material as the golf ball cover. Other methods known to those skilled in the art may also be employed.

The present invention can be used in forming golf balls of any desired size. "The Rules of Golf" by the USGA dictates that the size of a competition golf ball be at least 1.680 inches in diameter, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred, however diameters anywhere in the range of from 1.60 to about 1.95 inches can be used. Oversize golf balls with diameters above about 1.760 inches to as big as 2.75 inches are also within the scope of the present invention.

Preferred embodiments of the balls of the invention are shown in FIGS. 1–5. In FIG. 1, the golf ball 1 comprises a core 2 of conventional materials and a cover 3 comprising at least one saturated polyurethane.

Figure 2:
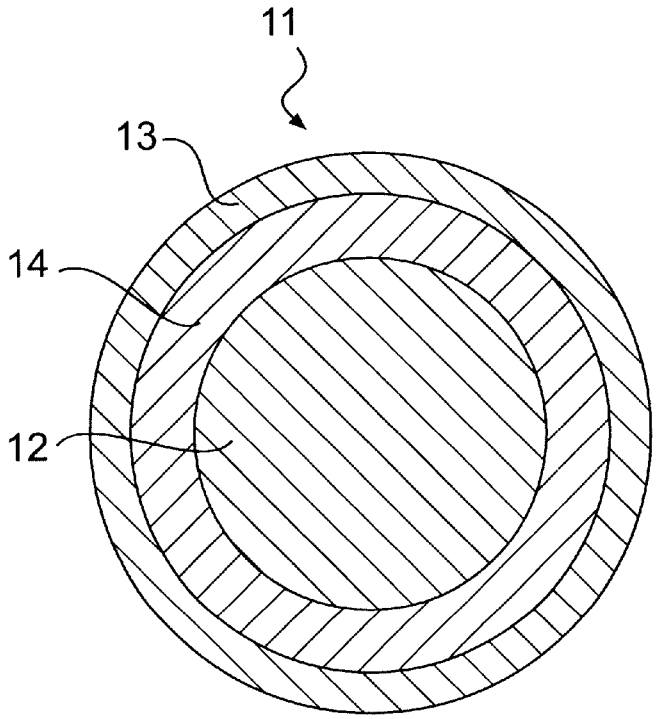
FIG. 2 is a cross-sectional view of a multi-component golf ball wherein at least one intermediate layer is formed from a composition comprising at least one saturated polyurethane.

FIG. 2 illustrates a multi-piece golf ball 11, which comprises a cover 13, at least one intermediate layer 14 and a core 12. The intermediate layer is comprised of at least one saturated polyurethane.

Figure 3:
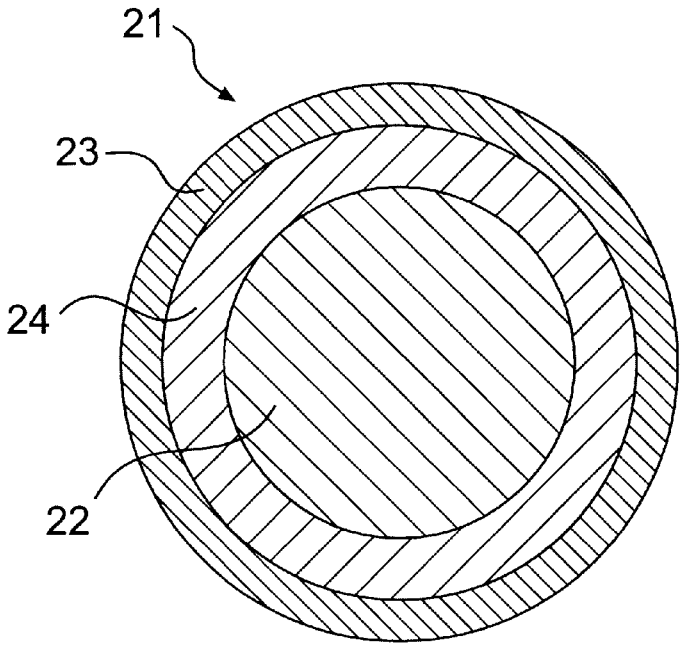
FIG. 3 is a cross-sectional view of a multi-component golf ball wherein the cover and an intermediate layer are formed from a composition comprising at least one saturated polyurethane.

The golf ball 21 of FIG. 3 has a core 22 made of conventional materials, and at least one intermediate layer 24 and cover 23 comprising at least one saturated polyurethane.

Figure 4:
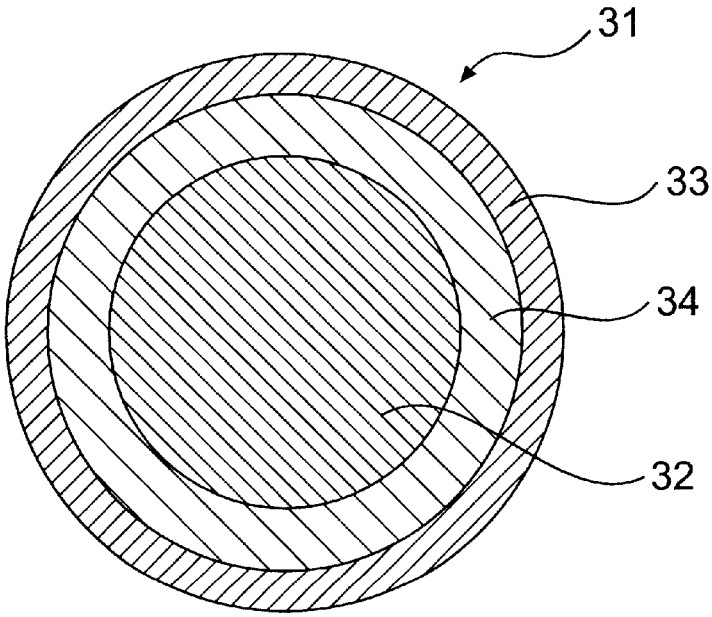
FIG. 4 is a cross-sectional view of a wound golf ball wherein the core is surrounded by a tensioned elastomeric material and the cover is formed from a composition comprising at least one saturated polyurethane.

The wound golf ball 31 of FIG. 4 has a core 32 made of conventional materials, an intermediate layer comprising a tensioned elastomeric material 34 and cover 33 comprising at least one saturated polyurethane.

Figure 5:
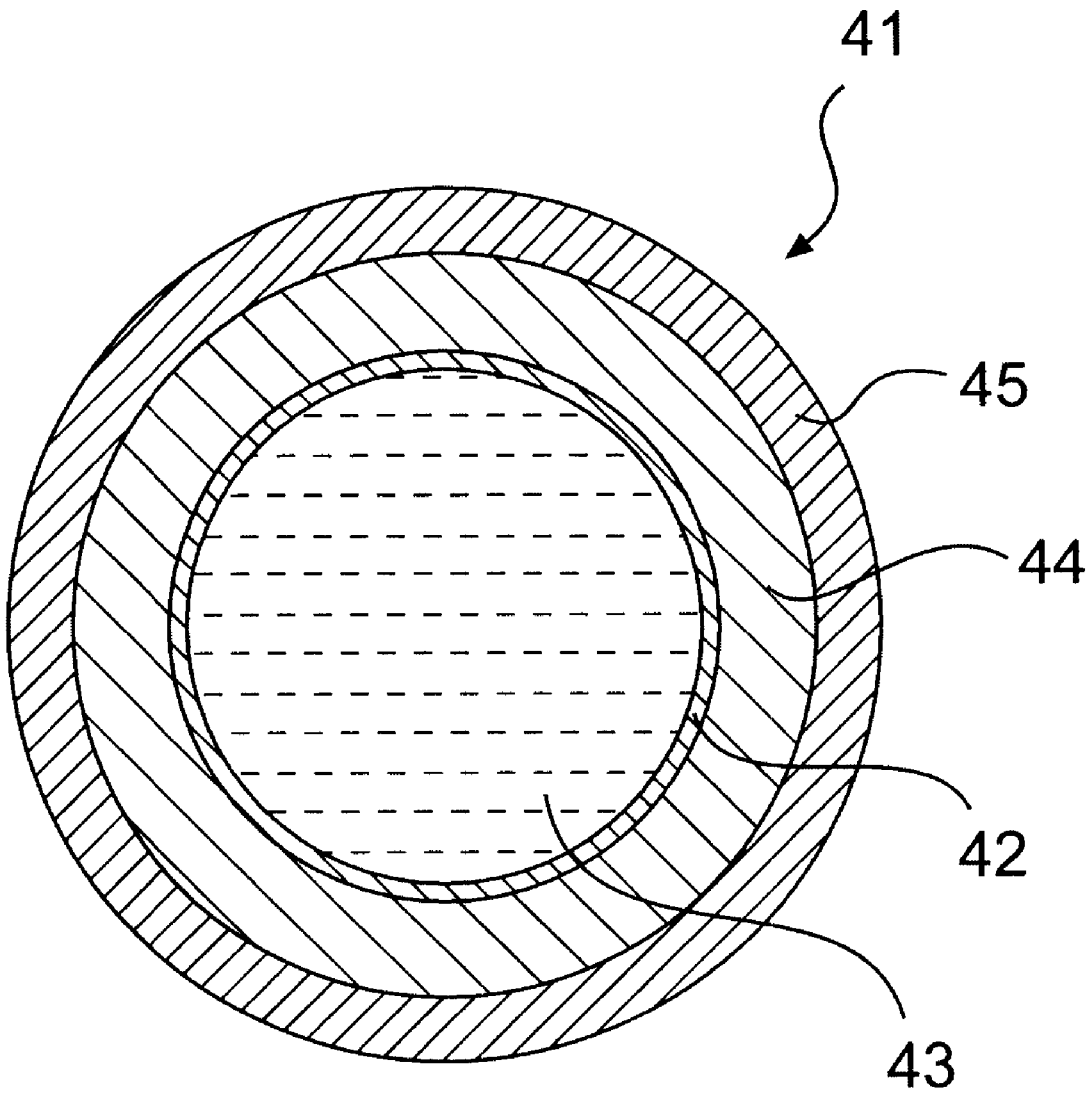
FIG. 5 is a cross-sectional view of a liquid center golf ball wherein the liquid core is surrounded by a tensioned elastomeric material and the cover is formed from a composition comprising at least one saturated polyurethane
Figure 6:
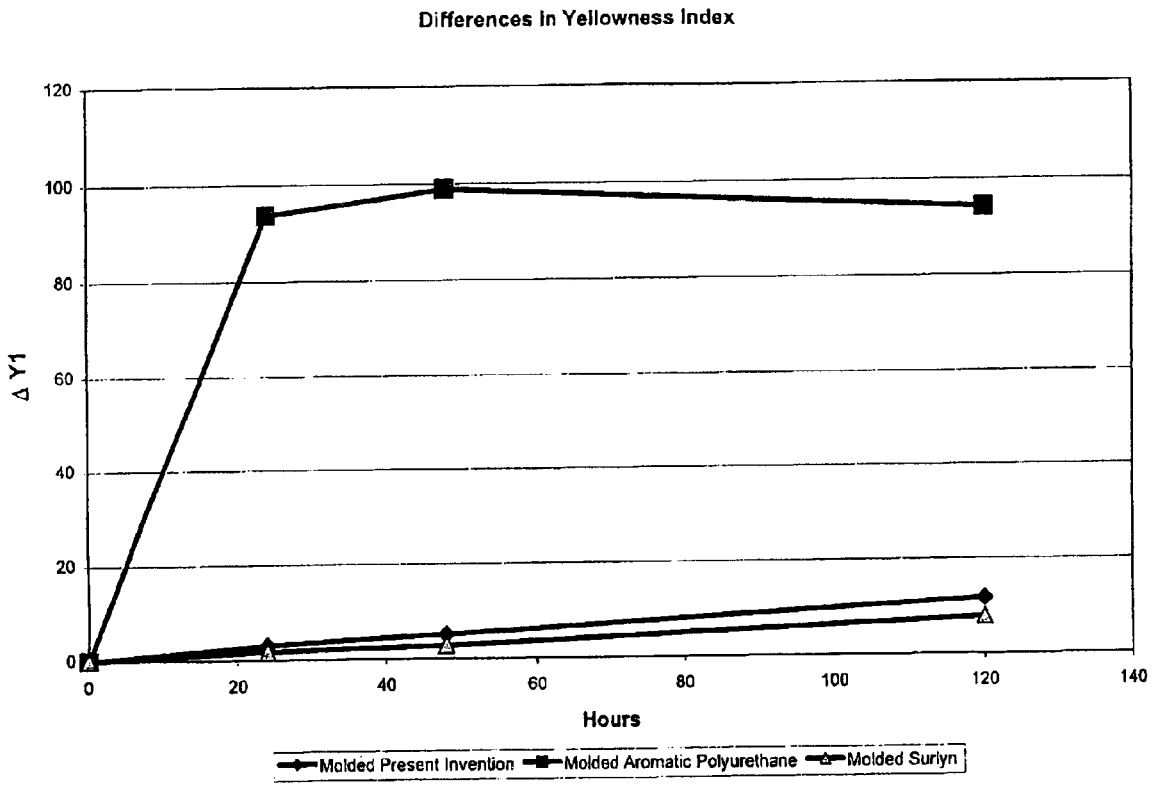
FIG. 6 is a graphical representation of UV stability data of tables V–VII

The wound, liquid center golf ball 41 of FIG. 5 has a hollow spherical core shell 42 with its hollow interior filled with a liquid 43, a thread rubber layer comprising a tensioned elastomeric material 44 and a cover 45 comprising at least one saturated polyurethane elastomer.

The invention will now be illustrated by the following examples. The examples are not intended to be limiting of the scope of the present invention. In conjunction with the general and detailed descriptions above, the examples provide further understanding of the present invention. Parts are by weight unless otherwise indicated.

EXAMPLES

Example 1

Table I below illustrates the components used to make a first saturated polyurethane golf ball cover composition:

TABLE I

| Chemicals | Weight (g) |
|---|---|
| IPDI Prepolymer* | 458.73 |
| 1,4-Butanediol | 42.75 |
| HCC-19584 Color Dispersion** | 17.55 |

*Prepolymer is the reaction product of isophorone diisocyanate and polytetramethylene ether glycol.
**HCC-19584 is a white-blue color dispersion manufactured by Harwick Chemical Corporation.

A golf ball was made having the cover formulated from the composition above following the teachings of U.S. Pat. No. 5,733,428 issued on Mar. 31, 1998. This ball was tested and the physical properties and the ball performance were listed in Table II.

TABLE II

| Physical Properties | Present Invention |
|---|---|
| Cover Hardness, D | 68 |
| Weight, g | 45.20 |
| Compression | 103 |
| Shear Resistance | Good |
| Color Stability | Comparable to Surlyn |

Example 2

Table III below illustrates the components used to make a second saturated polyurethane golf ball cover composition

TABLE III

| Chemicals | Weight (g) |
|---|---|
| HMDI Prepolymer* | 598.58 |
| 1,4-Cyclohexanedimethanol | 68.50 |
| HCC-19584 Color Dispersion | 23.35 |

*Prepolymer is the reaction product of 4,4'-dicyclohexylmethane diisocyanate and polytetramethylene ether glycol.

A golf ball was made having the cover formulated from the composition above following the teachings of U.S. Pat. No. 5,733,428 issued on Mar. 31, 1998. This ball was tested and the physical properties and the ball performance were listed in Table IV.

TABLE IV

| Physical Properties | Present-Invention |
|---|---|
| Cover Hardness, D | 54 |
| Weight, g | 45.58 |
| Compression | 89 |
| Shear Resistance | Good |
| Color Stability | Comparable to Surlyn |

The molded balls from the above composition listed in Table II are further subjected to a QUV test. The test method is described below.

Method

ASTM G 53-88 "Standard Practice for Operating Light and Water-Exposure Apparatus (Fluorescent UV-Condensation Type) for Exposure of Nonmetallic Materials" was followed with certain modifications as described below:

Six balls of each variety under evaluation were placed in custom made golf balls holders and inserted into the sample rack of a Q-PANEL model QUV/SER Accelerated Weathering Tester manufactured by Q-Panel Lab Products of Cleveland Ohio. The sample holders were constructed such that each ball was approximately 1.75 inches from a UVA-340 bulb, at its closest point. The weathering tester was then cycled every four hours between the following two sets of conditions (for the specified total length of time, 24, 48, and 120 hours): Condition #1—water bath temperature=50° C. with the UV lamps on, set and controlled at an irradiance power of 1.00W/m$^2$/nm. Condition #2—weather bath temperature=40° C. with the UV lamps turned off.

Color was measured before weathering and after each time cycle using a BYK-Gardner Model TCS II sphere type Spectrophotometer equipped with a 25 mm port. A D65/10° illumination was used in the specular reflectance included mode.

The test results for the molded balls after 24 hours of UV exposure are tabulated in Table V.

TABLE V

| | UV Stability Data | | | | | | | |
|---|---|---|---|---|---|---|---|---|
| Sample | ΔL* | Δa* | Δb* | ΔC* | ΔH* | ΔE*ab | ΔW1(E313) | ΔY1(D1925) |
| Molded Present Invention | −0.21 | −0.30 | 1.54 | −1.26 | −0.94 | 1.58 | −9.07 | 2.99 |
| Molded Aromatic Polyurethane | −17.27 | 11.36 | 46.14 | 47.31 | 4.36 | 50.56 | −142.35 | 93.80 |
| Molded Surlyn | −0.39 | −0.25 | 0.91 | −0.76 | −0.55 | 1.02 | −6.19 | 1.69 |

The test results for the molded balls after 48 hours of UV exposure are tabulated in Table VI

TABLE VI

| | UV Stability Data | | | | | | | |
|---|---|---|---|---|---|---|---|---|
| Sample | ΔL* | Δa* | Δb* | ΔC* | ΔH* | ΔE*ab | ΔW1(E313) | ΔY1(D1925) |
| Molded Present Invention | −0.48 | −0.37 | 2.54 | −2.02 | −1.59 | 2.61 | −15.16 | 4.98 |
| Molded Aromatic Polyurethane | −23.46 | 15.01 | 42.75 | 45.18 | 3.44 | 51.02 | −127.75 | 98.96 |
| Molded Surlyn | −0.54 | −0.39 | 1.43 | −1.18 | −0.91 | 1.58 | −9.50 | 2.66 |

The test results for the molded balls after 120 hour of UV exposure are tabulated in Table VII.

TABLE VII

| | UV Stability Data | | | | | | | |
|---|---|---|---|---|---|---|---|---|
| Sample | ΔL* | Δa* | Δb* | ΔC* | ΔH* | ΔE*ab | ΔW1(E313) | ΔY1(D1925) |
| Molded Present Invention | −0.92 | −0.46 | 5.87 | −3.01 | −5.06 | 5.96 | −33.72 | 1.68 |
| Molded Aromatic Polyurethane | −30.06 | 16.80 | 33.37 | 37.29 | 2.11 | 47.95 | −107.12 | 94.42 |
| Molded SURLYN® | −0.99 | −0.85 | 4.06 | −2.91 | −2.96 | 4.26 | −24.88 | 7.73 |

ΔL* = Difference in L dimension (light to dark)

Δa* = Difference in the a chroma dimension (red to green)

Δb* = Difference in the b chroma dimension (yellow to blue)

ΔC* = Combined chroma difference (a* and b* scales), hue and saturation

ΔH* = Total hue difference, excludes effects of saturation and luminescence

ΔE* = Total color difference

ΔW1 = Difference in the whiteness index

ΔY1 = Difference in the yellowness index

Balls formed with the saturated polyurethane compositions of the invention typically have a Atti compression above 55, preferably between 60 and 120. As used herein, the term "Atti compression" is defined as the deflection of an object or material relative to the deflection of a calibrated spring, as measured with an Atti Compression Gauge, that is commercially available from Atti Engineering Corp. of Union City, N.J. The outer cover hardness, measured on a durometer, should be at least 40 on the Shore D scale, and preferably between about 45 and 80, while the hardness of an intermediate layer comprising the saturated polyurethane compositions should be at least 15 on the Shore A scale. The thickness of the outer cover layer should be between about 0.02 inch and 0.35 inch, while the thickness of an intermediate layer comprising the saturated polyurethane compositions should be at least 0.02 inch. The specific gravity of a cover or intermediate layer comprising the saturated polyurethane compositions should be at least 0.7. The flexural modulus of a cover or intermediate layer comprising the saturated polyurethane compositions should be at least 500 psi. The percent dimple coverage on the surface of a golf ball of the invention should be at least 60%, and preferably should be at least 70%.

All patents and patent applications cited in the foregoing text are expressly incorporated herein by reference in their entirety.

It will be understood that the claims are intended to cover all changes and modifications of the preferred embodiments of the invention, herein chosen for the purpose of illustration, which do not constitute a departure from the spirit and scope of the invention.

What is claimed is:

1. A golf ball comprising at least one cast cover layer, wherein said cover layer is cast from a saturated polyurethane composition comprising at least one prepolymer and at least one curing agent, said cover layer having a thickness of from about 0.02 inch to about 0.3 inch, a hardness of at least about 40 Shore D, a specific gravity of at least about 0.7, a flexural modulus of at least about 500 psi and at least about 60 percent dimple coverage, said golf ball having a PGA compression of from about 55 to about 120.

2. The golf ball of claim 1, wherein the cover layer has a thickness of from about 0.02 inch to about 0.125 inch and a hardness of between about 40 and about 80 Shore D.

3. The golf ball of claim 1, wherein the golf ball further comprises a core optionally comprised of a plurality of layers and at least one intermediate layer interposed between an innermost cover layer and an outermost core layer, wherein said intermediate layer is formed from a composition which comprises at least one saturated polyurethane, said intermediate layer having a thickness of at least about 0.02 inch, a hardness of at least about 40 Shore A, a specific gravity of at least about 0.7 and a flexural modulus of at least about 500 psi.

4. The golf ball of claim 1, wherein said saturated polyurethane is a reaction product of at least one saturated diisocyanate, at least one saturated polyol and at least one saturated curing agent.

5. The golf ball of claim 4 wherein said saturated diisocyanate is selected from the group consisting of ethylene diisocyanate; propylene-1,2-diisocyanate; tetramethylene-1,4-diisocyanate; 1,6-hexamethylene-diisocyanate (HDI); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate (IPDI); methyl cyclohexylene diisocyanate; triisocyanate of HDI; triisocyanate of 2,2,4-trimethyl-1,6-hexane diisocyanate (TMDI); 4,4'-dicyclohexylmethane diisocyanate (HMDI) and mixtures thereof.

6. The golf ball of claim 4 wherein said saturated polyol is selected from the group consisting of polytetramethylene ether glycol (PTMEG); poly(oxypropylene) glycol; polyethylene adipate glycol; polyethylene propylene adipate glycol; polybutylene adipate glycol; polycarbonate glycol; ethylene oxide-capped polyoxypropylene diol; diethylene glycol initiated polycaprolactone; 1,4-butanediol initiated polycaprolactone; 1,6-hexanediol initiated polycaprolactone; trimethylol propane initiated polycaprolactone; neopentyl glycol initiated polycaprolactone; polytetramethylene ether glycol (PTMEG) initiated polycaprolactone and mixtures thereof.

7. The golf ball of claim 4 wherein said saturated curing agent is selected from the group consisting of 1,4-butanediol; isomers and mixtures of cyclohexyldimethylol; ethylene glycol; diethylene glycol; polytetramethylene ether glycol; propylene glycol; trimethanolpropane; tetra-(2-hydroxypropyl)-ethylenediamine; isomers and mixtures of cyclohexanebis(methylamine); triisopropanolamine; 4,4'-dicyclohexylmethane diamine; isomers and mixtures of diaminocyclohexane; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino) cyclohexane; 1,4-bis-(sec-butylamino)cyclohexane; isophorone diamine; hexamethylene diamine; propylene diamine; 1-methyl-2,4-cyclohexyl diamine; 1-methyl-2,6-cyclohexyl diamine; ethylene diamine; diethylene triamine; triethylene tetramine; tetraethylene pentamine; 1,3-diaminopropane; dimethylamino propylamine; diethylamino propylamine; imido-bis-propylamine; monoethanolamine; diethanolamine; triethanolamine; monoisopropanolamine; diisopropanolamine and mixtures thereof.

8. The golf ball of claim 1 wherein the composition further comprises at least one additional thermoplastic or thermoset component.

9. The golf ball of claim 8, wherein the additional component is a material selected from the group consisting of polyurethanes, epoxy resins, polyethylenes, polyamides, polyesters, acid copolymers or their ionomer derivatives and blends thereof.

10. The golf ball of claim 8 wherein the composition comprises about 10 to about 90 weight percent of the saturated polyurethane.

11. The golf ball of claim 1 wherein the golf ball further comprises a core optionally comprised of a plurality of layers and at least one intermediate layer interposed between an innermost core layer and an outermost core layer, wherein said intermediate layer is formed from a composition which comprises at least one saturated polyurethane.

12. The golf ball of claim 1 wherein the saturated polyurethane is foamed.

13. The golf ball of claim 1, wherein the golf ball is a solid or wound ball having a fluid filled solid or hollow center.

14. A golf ball comprising a solid core and a cover, wherein the cover is cast from a saturated polyurethane composition comprising at least one prepolymer and at least one curing agent, wherein the cover has a specific gravity of at least about 0.7 and a flexural modulus of at least about 500 psi, and wherein the golf ball has a PGA compression of from about 55 to about 120.

15. The golf ball of claim 14, wherein the saturated polyurethane is a reaction product of at least one saturated diisocyanate, at least one saturated polyol, and at least one curing agent.

16. The golf ball of claim 15, wherein the saturated diisocyanate is selected from the group consisting of ethylene diisocyanate; propylene-1,2-diisocyanate; tetramethylene-1,4-diisocyanate; 1,6-hexamethylene-diisocyanate (HDI); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate (IPDI); methyl cyclohexylene diisocyanate; triisocyanate of HDI; triisocyanate of 2,2,4-trimethyl-1,6-hexane diisocyanate (TMDI); 4,4'-dicyclohexylmethane diisocyanate (HMDI) and mixtures thereof.

17. The golf ball of claim 15, wherein the saturated polyol is selected from the group consisting of polytetramethylene ether glycol (PTMEG); poly(oxypropylene) glycol; polyethylene adipate glycol; polyethylene propylene adipate glycol; polybutylene adipate glycol; polycarbonate glycol; ethylene oxide-capped polyoxypropylene diol; diethylene glycol initiated polycaprolactone; 1,4-butanediol initiated polycaprolactone; 1,6-hexanediol initiated polycaprolactone; trimethylol propane initiated polycaprolactone; neopentyl glycol initiated polycaprolactone; polytetramethylene ether glycol (PTMEG) initiated polycaprolactone and mixtures thereof.

18. The golf ball of claim 15, wherein the saturated curing agent is selected from the group consisting of 1,4-butanediol; isomers and mixtures of cyclohexyldimethylol; ethylene glycol; diethylene glycol; polytetramethylene ether glycol; propylene glycol; trimethanolpropane; tetra-(2-hydroxypropyl)-ethylenediamine; isomers and mixtures of cyclohexanebis(methylamine); triisopropanolamine; 4,4'-dicyclohexylmethane diamine; isomers and mixtures of diaminocyclohexane; 2,2,4-trimethyl-1,6-hexanediamine; 2,4,4-trimethyl-1,6-hexanediamine; diethyleneglycol di-(aminopropyl) ether); 4,4'-bis-(sec-butylamino)-dicyclohexylmethane; 1,2-bis-(sec-butylamino)

cyclohexane; 1,4-bis-(sec-butylamino)cyclohexane; isophorone diamine; hexamethylene diamine, propylene diamine; 1-methyl-2,4-cyclohexyl diamine; 1-methyl-2,6-cyclohexyl diamine; ethylene diamine; diethylene triamine; triethylene tetramine; tetraethylene pentamine; 1,3-diaminopropane; dimethylamino propylamine; diethylamino propylamine; imido-bis-propylamine; monoethanolamine; diethanolamine; triethanolamine; monoisopropanolamine; diisopropanolamine and mixtures thereof.

19. The golf ball of claim 14, wherein the composition further comprises at least one additional component selected from the group consisting of polyurethanes, epoxy resins, polyethylenes, polyamides, polyesters, acid copolymers or their ionomer derivatives and blends thereof.

20. The golf ball of claim 14, wherein the core is formed of a composition comprising polybutadiene.

21. A golf ball comprising a core, an inner cover layer, and an outer cover layer, wherein the outer cover layer cover layer is cast from a saturated thermoset polyurethane composition comprising at least one prepolymer and at least one curing agent, wherein the at least one cover layer has a thickness of from about 0.02 inch to about 0.3 inch, a hardness of at least about 40 Shore D. a specific gravity of at least about 0.7, and wherein the golf ball has a PGA compression of about 55 to about 120.

22. The golf ball of claim 21, wherein said saturated polyurethane is a reaction product of at least one saturated diisocyanate, at least one saturated polyol and at least one saturated cuing agent.

23. The golf ball of claim 22, wherein said saturated diisocyanate is selected from the group consisting of ethylene diisocyanate; propylene-1,2-diisocyanate; tetramethylene-1,4-diisocyanate; 1,6-hexamethylene-diisocyanate (HDI); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate (IPDI); methyl cyclohexylene diisocyanate; triisocyanate of HDI; triisocyanate of 2,2,4-trimethyl-1,6-hexane diisocyanate (TMDI), 4,4'-dicyclohexylmethane diisocyanate (HMDI) and mixtures thereof.

24. The golf ball of claim 22, wherein said saturated polyol is selected from the group consisting of polytetramethylene ether glycol (PTMEG); poly(oxypropylene)glycol; polyethylene adipate glycol; polyethylene propylene adipate glycol; polybutylene adipate glycol; polycarbonate glycol; ethylene oxide-capped polyoxypropylene diol; diethylene glycol initiated polycaprolactone; 1,4-butanediol initiated polycaprolactone, 1,6-hexanediol initiated polycaprolactone; trimethylol propane initiated polycaprolactone; neopentyl glycol initiated polycaprolactone; polytetramethylene ether glycol (PTMEG) initiated polycaprolactone and mixtures thereof.

25. The golf ball of claim 22, wherein said saturated curing agent is selected from the group consisting of 1,4-butanediol; isomers and mixtures of cyclohexyldimethylol; ethylene glycol; diethylene glycol; polytetramethylene ether glycol; propylene glycol; trimethanolpropane; tetra-(2-hydroxypropyl)-ethylenediamine, isomers and mixtures of cyclohexanebis(methylamine); triisopropanolamine; 4,4'-dicyclohexylmethane diamine; isomers and mixtures of diaminocyclohexane; 2,2,4-trimethyl-1,6-hexanediamine; 2,4,4-trimethyl-1,6-hexanediamine; diethyleneglycol di-(aminopropyl)ether); 4,4'-bis-(sec-butylamino)-dicyclohexylmethane; 1,2-bis-(sec-butylamino) cyclohexane; 1,4-bis-(sec-butylamino)cyclohexane; isophorone diamine; hexamethylene diamine; propylene diamine; 1-methyl-2,4-cyclohexyl diamine; 1-methyl-2,6-cyclohexyl diamine; ethylene diamine; diethylene triamine; triethylene tetramine; tetraethylene pentamine 1,3-diaminopropane; dimethylamino propylamine; diethylamino propylamine; imido-bis-propylamine; monoethanolamine; diethanolamine; triethanolamine; monoisopropanolamine; diisopropanolamine and mixtures thereof.

* * * * *